US007107709B2

(12) United States Patent
Hamel

(10) Patent No.: US 7,107,709 B2
(45) Date of Patent: Sep. 19, 2006

(54) ARTICULATED SCRAPER BLADE SYSTEM

(76) Inventor: Guy Hamel, 905, Rte Laurier, ste-Croix (CA) G0S 2H0

( * ) Notice: Subject to any disclaimer, the term of this patent is extended or adjusted under 35 U.S.C. 154(b) by 0 days.

(21) Appl. No.: 10/439,823

(22) Filed: May 19, 2003

(65) Prior Publication Data

US 2004/0231201 A1 Nov. 25, 2004

(51) Int. Cl.
*E01H 5/04* (2006.01)

(52) U.S. Cl. ..... 37/232; 172/264

(58) Field of Classification Search ..... 37/232, 37/233, 264, 266, 263, 458, 446; 172/261, 172/264, 265, 817
See application file for complete search history.

(56) References Cited

U.S. PATENT DOCUMENTS 1,383,409 A * 7/1921 Volney ..... 37/233
3,772,803 A * 11/1973 Cote ..... 37/233
4,570,366 A * 2/1986 Yost ..... 37/232
4,794,710 A * 1/1989 Haring ..... 37/232
5,140,763 A * 8/1992 Nichols, IV ..... 37/233
5,191,729 A * 3/1993 Verseef ..... 37/232
5,471,770 A * 12/1995 Ferreira ..... 37/264
5,697,172 A * 12/1997 Verseef ..... 37/232
5,819,443 A * 10/1998 Winter ..... 37/233
6,094,845 A * 8/2000 Lela ..... 37/219

* cited by examiner

*Primary Examiner*—Victor Batson

(57) ABSTRACT

An articulated scraper blade system mounted to a snow plow blade length installed in the front of a vehicle for snow scraping, which comprises a multitude of carbide sections moving independently when they strike an obstacle on a road surface.

1 Claim, 5 Drawing Sheets

ARTICULATED SCRAPER BLADE SYSTEM

BACKGROUND OF THE INVENTION

1. Field of the Invention

Figure 1:
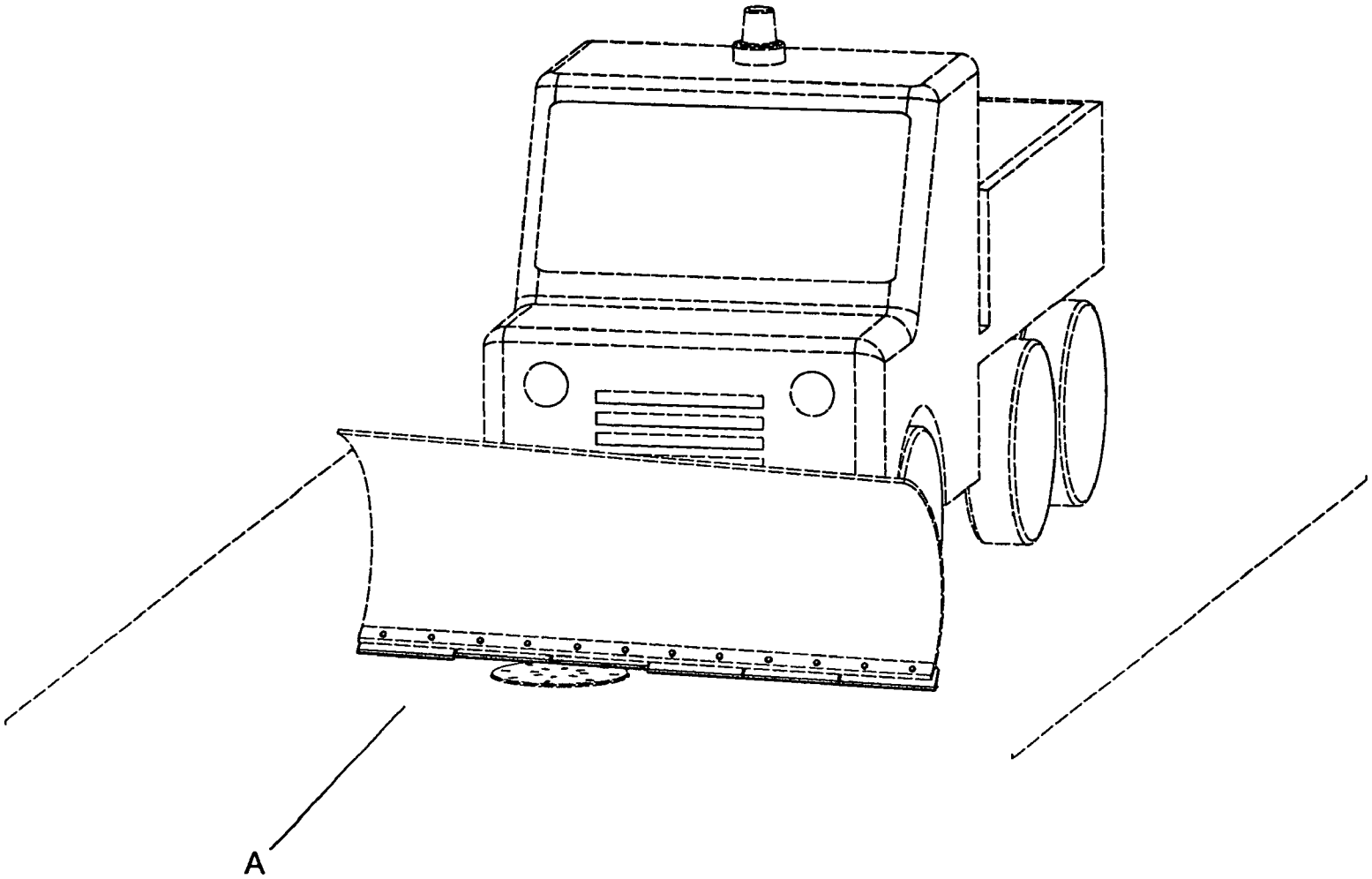

More paticularly, this invention relates to an articulated scraper blade system mounted to a snow plow blade length installed in the front of a vehicle for snow scraping, made up of which comprises a multitude of carbide sections moving independently when they strike an obstacle on a road surface.

2. Description of the Related Art

A search of prior art records has unveiled the following patents:

1. U.S. Pat. No. 2,282,298 issued in 1942 to Vogel;
2. CA 2,242,278 issued in 1998 to Daniels;
3. U.S. Pat. No. 5,865,997 issued in 1997 to Isaacs;
4. U.S. Pat. No. 3,906,577 issued in 1973 to Brucher;
5. FR 2,539,438 issued in 1984 to Kueper;
6. U.S. Pat. No. 4,258,797 issued in 1978 to Mckenzie;
7. WO 9,107,547 issued in 1989 to Turpeinen;
8. WO 9,005,218 issued in 1988 to Andersson;
9. U.S. Pat. No. 5,813,150 issued in 1996 to Davis;
10. DE 4,100,545 issued in 1991 to Nusser;
11. DE 3,937,634 issued in 1991 to Schulz;
12. U.S. Pat. No. 5,513,453 issued in 1994 to Norton;
13. EP 0,846,808 issued in 1997 to Maier;
14. U.S. Pat. No. 5,881,480 issued in 1996 to Fall;
15. EP 0,279,338 issued in 1988 to Hallissy; and
16. U.S. Pat. No. 5,241,763 issued in 1991 to Dynan;

The patents to Vogel and Kueper are probably the most relevant.

Accordingly, it is a principal object of the present invention to provide a snowplow blade length with an articulated scraper blade system of for snow scraping, which comprises a multitude of carbide sections moving independently when they strike an obstacle on a road surface.

SUMMARY OF THE INVENTION

According to the present invention, there is described an articulated scraper blade system mounted to a snow plow blade length installed in the front of a vehicle for snow scraping, which comprises a multitude of carbide sections moving independently when they strike an obstacle on a road surface.

BRIEF DESCRIPTION OF THE SEVERAL VIEWS OF THE DRAWING(S)

Figure 2:
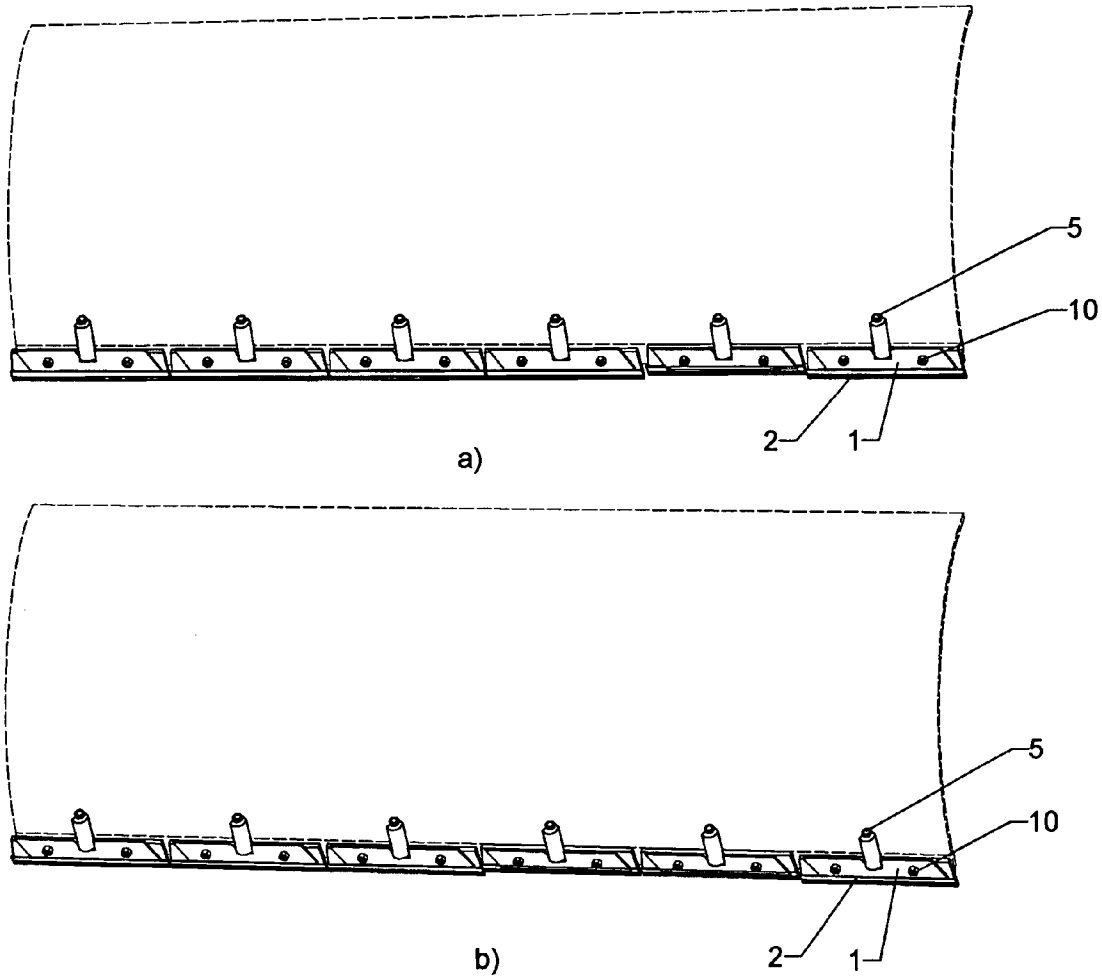
Figure 3:
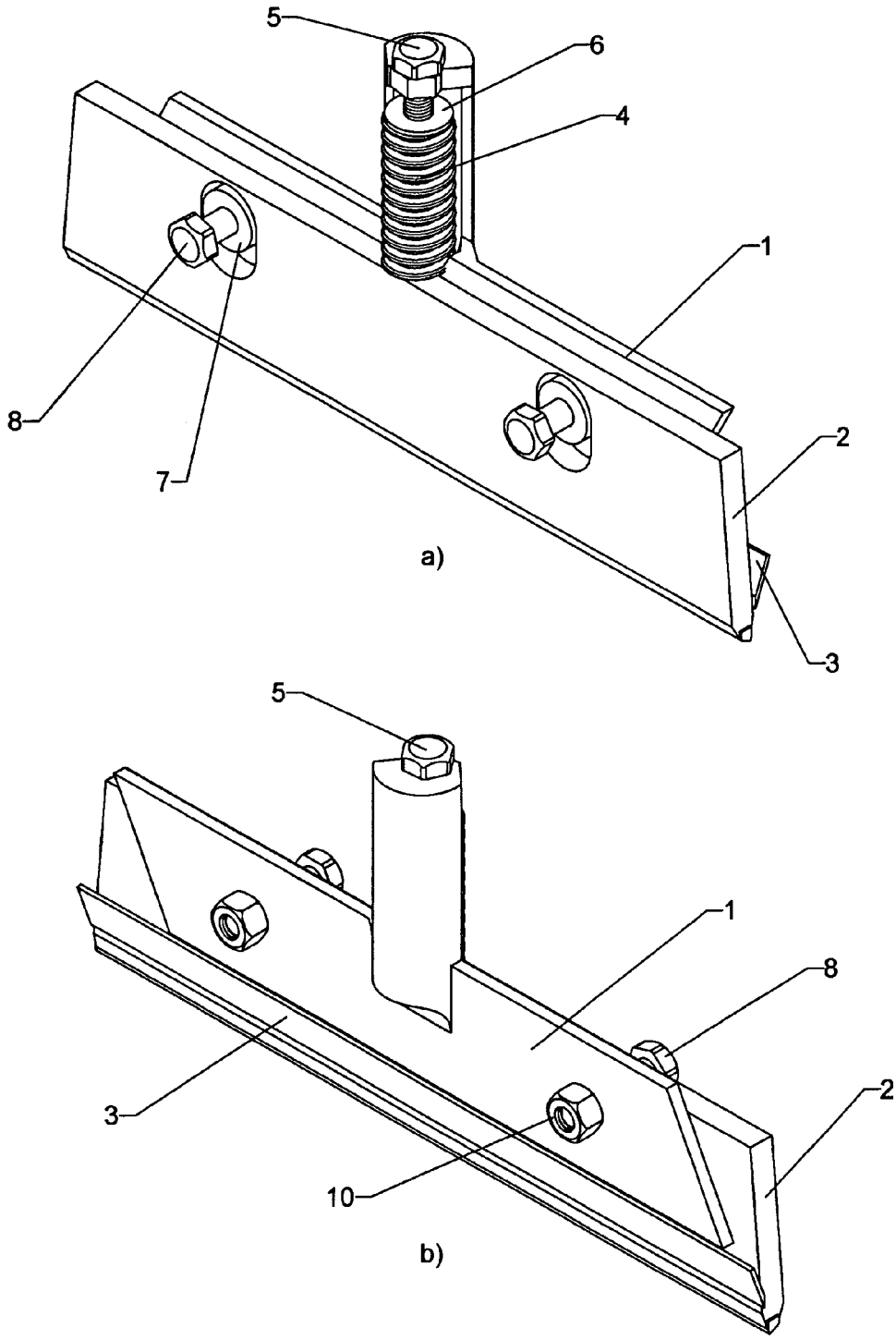
Figure 4:
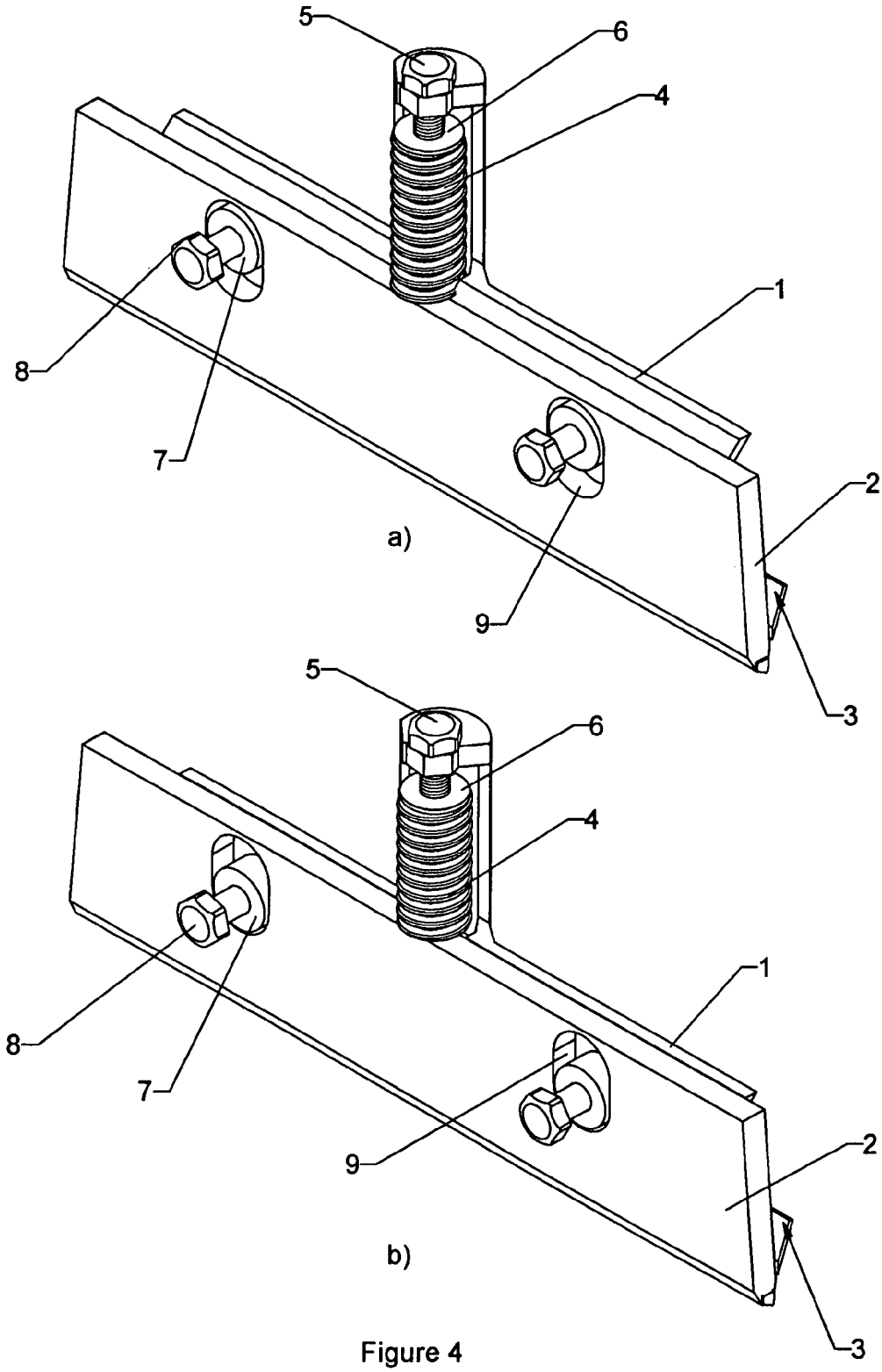
Figure 5:
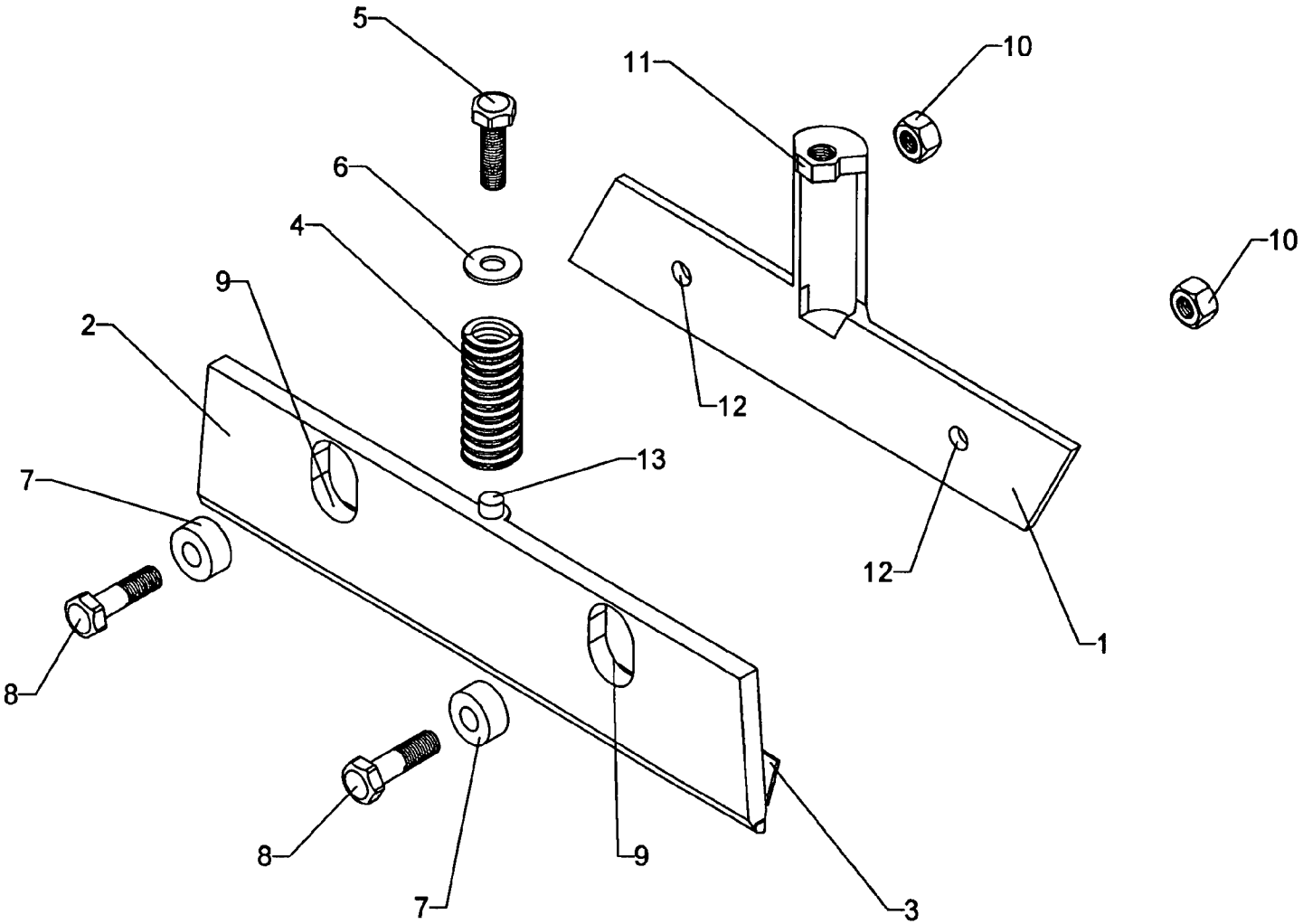

The invention will be described more in detail herein below relating to the enclosed drawings in which some embodiments are shown;

FIG. 1 is a perspective view of an articulated scraper blade system made up of a multitude of carbide sections moving independently, which are mounted to a snowplow blade length installed on the front of a vehicle;

FIG. 2*a* is a front view of the snowplow blade length showing the articulated scraper blade system made up of a multitude of carbide sections moving independently which one carbide section is shown in a raised position;

FIG. 2*b* is a front view of the snowplow blade showing the articulated scraper blade system made up of a multitude of carbide sections moving independently which two carbide sections are shown in a raised position;

FIG. 3*a* is a perspective rear view of a carbide section;

FIG. 3*b* is a perspective front view thereof;

FIG. 4*a* is a perspective rear view showing a carbide section in a lowered position;

FIG. 4*b* is a perspective rear view showing a carbide section in a raised position; and FIG. 5 is an exploded view thereof.

NUMERICAL REFERENCES OF THE ILLUSTRATED ELEMENTS

Structural plate member (1)
Plate member (2)
Snow deflector (3)
Spring force (4)
Bolt (5)
Flat washer (6)
Iron wedge (7)
Bolt (8)
Slip gap (9)
Nut (10)
Threaded aperture (11)
Aperture (12)
Iron pin (13)

DETAILED DESCRIPTION OF THE INVENTION

Now referring to the accompanying drawings, and in particular to FIG. 1, there is shown in phantom lines a snowplow blade length installed on the front of a vehicle, and on which is mounted an articulated scraper blade system (A) made up of a multitude of carbide sections for snow scraping, and which each carbide section moves independently when it strikes an obstacle on a road surface.

As illustrated in FIG. 2*a*, there is shown a multitude of carbide sections mounted to a snowplow blade length moving independently, and which one carbide section is shown in a raised position.

As illustrated in FIG. 2*b*, there is shown a multitude of carbide sections mounted to a snowplow blade length moving independently, and which two carbide sections are shown in a raised position.

As illustrated in FIGS. 3*a*, 3*b*, 4*a*, 4*b* and 5, there is shown a carbide section comprising a plate member (2) having spaced and aligned slip gaps (9) formed therein, wherein each slip gap (9) allows the plate member (2) to be raised automatically when it strikes an obstacle on a road surface, and lowered automatically by a spring force (4) for the snow scraping.

The forward plate member (2) includes a snow deflector (3) formed to on its lower portion so as to avoid the accumulation of residue and ice inside the mechanism.

The plate member (2) also includes an iron pin (13) receiving the spring (4) on which is engaged a flat washer (6), and wherein the spring (4) is engaged inside an upper portion of the structural plate member (1) formed therein so as to allow removal of the spring (4), with the spring being blocked in place by a bolt (5) which is engaged into a threaded aperture (11).

Furthermore, the plate member (2) is connected to the structural plate member (1) and to snowplow blade length by each bolt (8) passing through each iron wedge (7) engaged inside each slip gap (9) and inside of each aperture (12), and wherein each bolt (8) is blocked in place by a nut (10).

Accordingly, while the preferred embodiments of the invention have been described above, it will be recognized and understood that various modifications may be made in the invention and the appended claims are intended to cover all such modifications which may fall within the spirit and scope of the invention.

I claim:

1. An articulated scraper blade system mounted to a snowplow blade installed in front of a vehicle, for snow scraping, said blade system comprises a multitude of carbide sections capable of moving independently when they strike an obstacle on a road surface, said blade system further comprising:

a forward plate member having spaced and aligned slip gaps formed therein, wherein each said slip gap allows said plate member to be raised automatically when it strikes an obstacle on the road surface, and lowered automatically by a spring exerting a spring force for snow scraping;

the forward plate member includes a snow deflector formed on a lower portion of the forward plate member, said snow deflector configured to avoid accumulation of residue and ice inside the blade system;

said forward plate member also includes an iron pin which receives said spring, with said spring engaging a flat washer, said spring positioned within a vertically extending upper portion of a structural plate member, said vertically extending upper portion configured to allow removal of said spring, said spring blocked in place by a bolt which is engaged in a threaded aperture; and said forward plate member being connected to said structural plate member and said snowplow blade by means of additional bolts, each said additional bolts passing through an iron wedge engaged inside each said slip gap, each said additional bolt further extending through additional apertures formed in said structural plate member, and wherein each said additional bolt is blocked in place by a nut.

* * * * *